US008439852B2

(12) United States Patent
Ebihara et al.

(10) Patent No.: US 8,439,852 B2
(45) Date of Patent: May 14, 2013

(54) WALK ASSISTANCE DEVICE

(75) Inventors: Yasuhiro Ebihara, Okazaki (JP); Kouta Oishi, Aichi-gun (JP); Yasuhiro Murata, Chiryu (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 109 days.

(21) Appl. No.: 13/242,220

(22) Filed: Sep. 23, 2011

(65) Prior Publication Data

US 2012/0016277 A1 Jan. 19, 2012

Related U.S. Application Data

(63) Continuation of application No. PCT/JP2010/056092, filed on Apr. 2, 2010.

(51) Int. Cl.
*A61H 1/00* (2006.01)
*A61H 1/02* (2006.01)
*A61H 5/00* (2006.01)

(52) U.S. Cl.
USPC ..... 601/5; 601/34

(58) Field of Classification Search ..... 601/5, 23, 601/33–36; 602/16, 23, 26
See application file for complete search history.

(56) References Cited

U.S. PATENT DOCUMENTS 5,848,979 A * 12/1998 Bonutti et al. ..... 601/5
6,224,521 B1 * 5/2001 Foucault ..... 482/112
2005/0273022 A1 * 12/2005 Diaz et al. ..... 601/5
2006/0064047 A1 * 3/2006 Shimada et al. ..... 602/23
2007/0027409 A1 2/2007 Katoh et al.
2010/0036302 A1 * 2/2010 Shimada et al. ..... 602/16

FOREIGN PATENT DOCUMENTS

| | | | |
|---|---|---|---|
| JP | 55-51265 | U | 4/1980 |
| JP | 9-99123 | A | 4/1997 |
| JP | 9-173398 | A | 7/1997 |
| JP | 2001-055710 | A | 2/2001 |
| JP | 2003-220102 | A | 8/2003 |
| JP | 2004-344305 | A | 12/2004 |
| JP | 2006-087478 | A | 4/2006 |
| JP | 2007-130459 | A | 5/2007 |
| JP | 2010-035899 | A | 2/2010 |
| WO | 2010/035706 | A1 | 4/2010 |

OTHER PUBLICATIONS

International Search Report of PCT/JP2010/056092 mailed May 18, 2010.

* cited by examiner

*Primary Examiner* — Kristen Matter
(74) *Attorney, Agent, or Firm* — Kenyon & Kenyon LLP

(57) ABSTRACT

A walk assistance device comprises a thigh unit configured to be arranged on a thigh of the user, a shank unit configured to be arranged on a shank of the user, a foot unit configured to be arranged on a foot of the user, a knee position joint unit configured to couple the thigh unit and the shank unit in a swingable manner, and an ankle position joint unit configured to couple the shank unit and the foot unit in a swingable manner. The shank unit comprises a first replaceable member and a second replaceable member that extend along the shank of the user, and a length of the shank unit is adjustable by replacing each of the first and second replaceable members with another one having a different length.

6 Claims, 3 Drawing Sheets

WALK ASSISTANCE DEVICE

CROSS-REFERENCE TO RELATED APPLICATIONS

This application is a continuation of PCT/JP2010/056092 filed on Apr. 2, 2010, the contents of which are incorporated by reference in its entirety.

TECHNICAL FIELD

The present invention relates to a walk assistance device for assisting a person to walk; in particular, the present invention relates to a walk assistance device fitted to a person's leg.

DESCRIPTION OF RELATED ART

A walk assistance device is taught in Japanese Unexamined Patent Application Publication No. 09-173398 (below, Patent Document 1). The walk assistance device is configured to be capable of being fitted to a person's leg, and can assist the person to walk by adjusting the movement of the leg. The walk assistance device comprises a thigh unit arranged on a thigh, a shank unit arranged on a shank, a foot unit arranged on a foot, and a knee position joint unit coupling the thigh unit and the shank unit in a swingable manner.

This type of walk assistance device is preferably adjustable in size to conform to the physical constitution of the user to whom it is fitted. Consequently, in e.g. the walk assistance device of Patent Document 1, the length of the shank unit is configured to be adjustable by fastening an upper portion and a lower portion of the shank unit by a bolt, and by having a bolt hole be a long hole. According to this configuration, the length of the shank unit can be adjusted by small breadth in accordance with the physical constitution of the user.

SUMMARY OF THE INVENTION

However, the above configuration requires the long hole to be formed in the shank unit, leading to a loss of strength in the shank unit. Further, since the direction in which force is applied to the shank unit is substantially the same as the longitudinal direction of the long hole, the bolt may move along the long hole when strong force is applied to the shank unit, inadvertently changing the length of the shank unit.

Taking the above problem into consideration, the present invention presents a technique that allows the size adjustment of a walk assistance device without requiring the formation of the long hole.

The present invention is realized in a walk assistance device for assisting a user to walk. This walk assistance device comprises a thigh unit configured to be arranged on a thigh of the user, a shank unit configured to be arranged on a shank of the user, a foot unit configured to be arranged on a foot of the user, a knee position joint unit configured to couple the thigh unit and the shank unit in a swingable manner, and an ankle position joint unit configured to couple the shank unit and the foot unit in a swingable manner. The shank unit comprises a first replaceable member and a second replaceable member that extend along the shank of the user, and a length of the shank unit is adjustable by replacing each of the first and second replaceable members with another one having a different length.

This walk assistance device has a configuration in which the length of the shank unit is adjustable by replacing the first and second replaceable members. According to this configuration, a long hole need not be formed in the shank unit, allowing loss of strength of shank unit to be avoided. Further, the length of the shank unit does not change even if strong force is applied to the shank unit, allowing the walking of the user to be assisted stably.

Further, in the above walk assistance device, not just one single replaceable member but a plurality of replaceable members that includes the first replaceable member and the second replaceable member is provided. Consequently, the length of the shank unit can be adjusted in multistep lengths by combining the first replaceable member and the second replaceable member. For example, in case the length of the shank unit were to be adjusted using only the first replaceable member, 30 pieces of first replaceable members having different lengths would need to be prepared for adjusting the length of the shank unit by 30 steps. Whereas, if the first replaceable member and the second replaceable member are combined, the length of the shank unit can be adjusted by, e.g., 30 steps by simply preparing a total of 13 pieces of replaceable members: 10 pieces of first replaceable members having different lengths and 3 pieces of second replaceable members having different lengths.

The first replaceable member and the second replaceable member may be formed from the same material or different material. Here, in case the first replaceable member and the second replaceable member are formed from different materials and, in case the first replaceable member and the second replaceable member have different densities, it is preferred that the replaceable member having a higher density is shorter than the replaceable member having a lower density. That is, if the first replaceable member has the higher density than the second replaceable member, it is preferred that the first replaceable member is shorter than the second replaceable member. According to this configuration, the weight of the shank unit can be reduced, allowing the burden on the user and the load on the knee position joint unit to be reduced.

Further, in case the first replaceable member has the higher density than the second replaceable member, it is preferred that the first replaceable member is located closer to the knee position joint unit than the second replaceable member. According to this configuration, the center of gravity of the shank unit is located closer to the knee position joint unit, allowing the moment of inertia of the shank unit to be smaller relative to the knee position joint unit. Thereby, the burden on the user and the load on the knee position joint unit can be reduced.

The first replaceable member is preferably made of metal material, and the second replaceable member is preferably made of fiber-reinforced material. Since processing of the metal material is generally easy, if the first replaceable member is made of metal material, a variety of first replaceable members can be prepared at low cost. On the other hand, since fiber-reinforced material generally has a high specific strength, if the second replaceable member is made of the fiber-reinforced material, the weight of the shank unit can be significantly reduced while its strength is ensured.

Furthermore, since processing of the fiber-reinforced material is generally difficult, preparing a variety of second replaceable members made from the fiber-reinforced material would increase the cost. Consequently, in case pluralities of the first and second replaceable members are prepared for adjusting the length of the shank unit, it is preferable to prepare the first replaceable members which are made of the easily-processed metal material in a greater quantity than the second replaceable members which are made of the fiber-reinforced material that is difficult to process. For example, in case the length of the shank unit is to be adjusted by 30 steps, it is better to prepare 10 pieces of first replaceable members and 3 pieces of second replaceable members rather than 3 pieces of first replaceable members and 10 pieces of second replaceable members. Thus, the first replaceable members and second replaceable members can be prepared at comparatively low cost.

The foot unit may comprise a sole member configured to be arranged on a sole and a third replaceable member extending from the sole member to the ankle position joint unit, and a distance from the sole member to the ankle position joint unit may be adjustable by replacing the third replaceable member with another one having a different length. According to this configuration, the location of the ankle position joint unit relative to the ankle of the user can be adjusted without forming a long hole in the foot unit.

The present invention presents a method for adjusting size of the walk assistance device. This adjusting method comprises preparing a plurality of the first replaceable members having lengths different from each other and a plurality of the second replaceable members having lengths different from each other, selecting one of the first replaceable members and one of the second replaceable members in accordance with a physical constitution of the user, and assembling the shank unit of the walk assistance device by using the selected first and second members. According to this adjusting method, the length of the shank unit is adjustable in multistep lengths by a variety of combinations of the first and second members which are selected, and the number of the multistep lengths is larger than the total number of the pluralities of first and second members which are prepared.

DETAILED DESCRIPTION OF THE INVENTION

Figure 1:
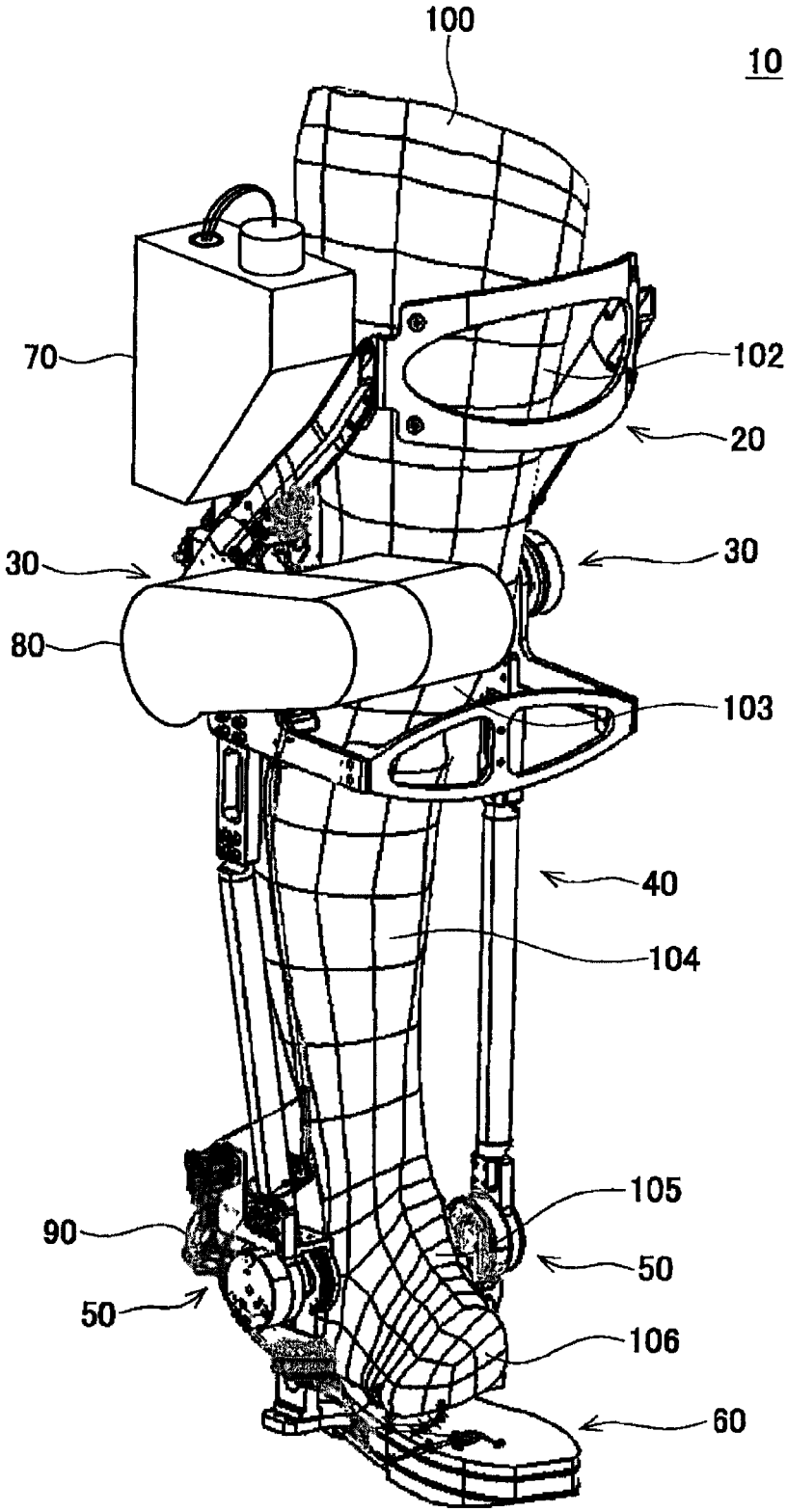
FIG. 1 is a perspective view showing the outer appearance of a walk assistance device.

An embodiment of the present invention will be described with reference to the figures. FIG. 1 is a perspective view showing a walk assistance device 10 of the embodiment. The walk assistance device 10 is fitted to a leg 100 of a user, and is a device for assisting that user to walk. The walk assistance device 10 is used, e.g., for the functional rehabilitation of a user who has difficulty in walking independently. In this case, the walk assistance device 10 is fitted to the dysfunctional leg of the user, and assists the user in walking by actively adjusting the movement of the leg.

As shown in FIG. 1, the walk assistance device 10 comprises a thigh unit 20 arranged on a thigh 102 of the user, a shank unit 40 arranged on a shank 104 of the user, and a foot unit 60 arranged on a foot 106 of the user. Further, the walk assistance device 10 comprises a pair of knee position joint units 30 that couples the thigh unit 20 and the shank unit 40 in a swingable manner, and a pair of ankle position joint units 50 that couples the shank unit 40 and the foot unit 60 in a swingable manner. The pair of knee position joint units 30 holds a knee 103 of the user therebetween, and is arranged coaxially with the knee 103. That is, one of the knee position joint units 30 is arranged coaxially with the knee 103 at the outside of the knee 103, and the other knee position joint unit 30 is arranged coaxially with the knee 103 at the inside of the knee 103. Similarly, the pair of ankle position joint units 50 holds an ankle 105 of the user therebetween, and is arranged coaxially with the ankle 105. That is, one of the ankle position joint units 50 is arranged coaxially with the ankle 105 at the outside of the ankle 105, and the other ankle position joint unit 50 is arranged coaxially with the ankle 105 at the inside of the ankle 105.

The walk assistance device 10 further comprises a control unit 70, a drive unit 80 and a sensor unit 90. As an example, the control unit 70 is provided on the thigh unit 20, the drive unit 80 is provided on the knee position joint units 30, and the sensor unit 90 is provided on the ankle position joint units 50. The drive unit 80 houses a motor, decelerator, and sensors, and can drive the knee position joint units 30. That is, the drive unit 80 can swing the shank unit 40 relative to the thigh unit 20. The sensor unit 90 has various types of sensors, and can detect the angle of the ankle position joint units 50 and whether the foot unit 60 is making contact with the ground. The control unit 70 has a small computer and a battery, and is electrically connected to the drive unit 80 and the sensor unit 90. The control unit 70 inputs detection signals from the sensor unit 90, and controls the operation of the drive unit 80 based on the detection signals that were input. The operation of the walk assistance device 10 is adjusted over time in accordance with the actual walking of the user.

Figure 2:
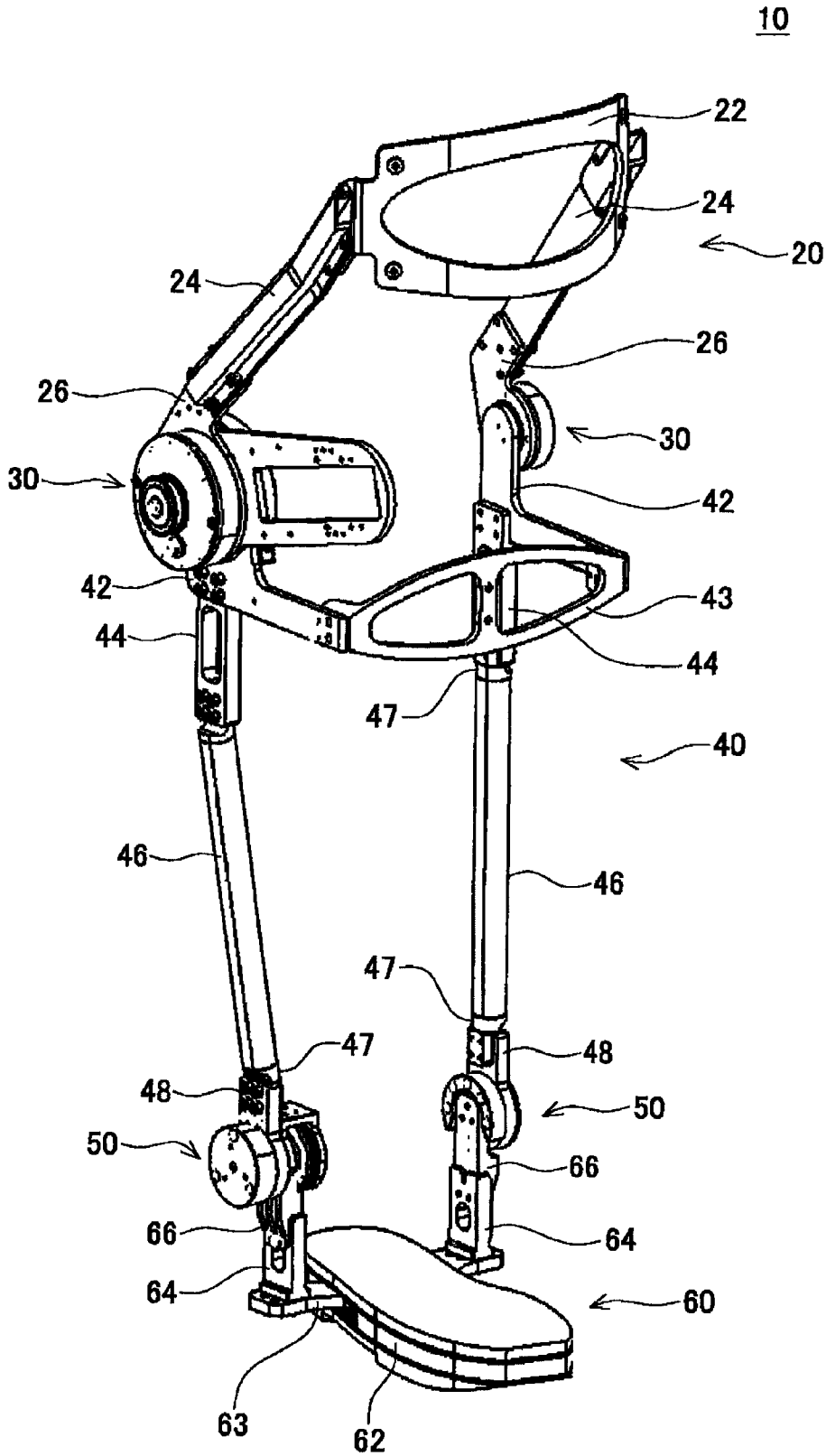
FIG. 2 is a perspective view showing the frame structure of the walk assistance device.

Next, the frame structure of the walk assistance device 10 will be described with reference to FIG. 2. FIG. 2 shows a perspective view of the frame structure of the walk assistance device 10.

First, the frame structure of the thigh unit 20 will be described. As shown in FIG. 2, the thigh unit 20 comprises a thigh plate member 22, a pair of thigh pillar members 24 and a pair of thigh base members 26. The thigh plate member 22 is arranged at the front of the thigh 102 of the user. The thigh plate member 22 has a pad and a belt (not shown), and is fixed firmly to the thigh 102 of the user by the belt. In other words, the thigh 102 of the user is fastened firmly to the thigh plate member 22 by the belt. Thus, the thigh 102 of the user is maintained such that it cannot move longitudinally, horizontally or vertically relative to the thigh plate member 22.

The thigh plate member 22 is supported by the pair of thigh pillar members 24. The thigh pillar members 24 are affixed to the thigh base members 26, and the thigh base members 26 are affixed to the knee position joint units 30. As an example, the thigh plate member 22 and the thigh pillar members 24 of the present embodiment are made of carbon fiber reinforced plastic (CFRP). Carbon fiber reinforced plastic is a type of the fiber-reinforced material and has a high specific strength. Consequently, the weight of the thigh plate member 22 and the thigh pillar members 24 can be reduced by the carbon fiber reinforced plastic that is a type of the fiber-reinforced material.

Figure 3:
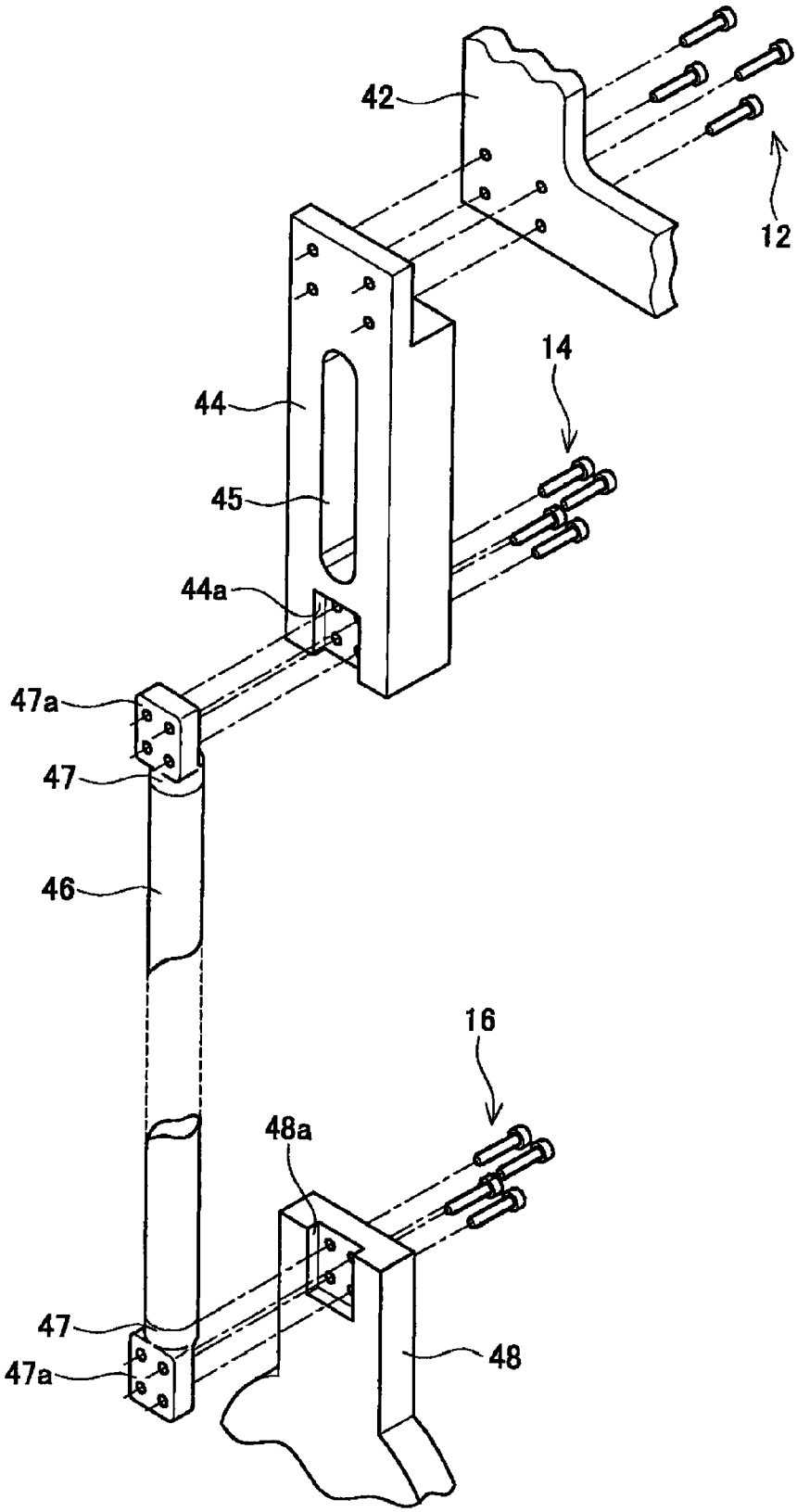
FIG. 3 shows a joining portion of a first replaceable member and a second replaceable member.

Next, the frame structure of the shank unit 40 will be described with reference to FIGS. 2, 3. Here, FIG. 3 shows an exploded view of the frame structure of the shank unit 40. The shank unit 40 comprises a pair of knee-side base members 42, a knee plate member 43, a pair of first pillar members 44, a pair of second pillar members 46 and a pair of ankle-side base members 48. The knee plate member 43 is arranged at the front of the knee 103 of the user, and makes contact from the front with a lower portion of the knee 103 of the user (i.e., an upper portion of the shank 104). The knee plate member 43 is supported by the pair of knee-side base members 42. Furthermore, with the exception of the knee plate member 43, the shank unit 40 does not make contact with the shank 104 of the user. That is, the shank 104 of the user is supported only from the front by the knee plate member 43 of the shank unit 40.

The knee-side base members 42 are L-shaped plate members. The knee-side base members 42 are made of metal material; specifically, of aluminum. One of the knee-side base members 42 is affixed to one of the knee position joint units 30 at the outside of the shank 104 of the user, and the other knee-side base member 42 is affixed to the other knee position joint unit 30 at the inside of the shank 104 of the user. That is, the knee-side base members 42 are coupled in a swingable manner to the thigh base members 26 via the knee position joint units 30. The knee plate member 43 is attached to end parts located at the front of the knee-side base members 42.

The first pillar members 44 are long and narrow plate members. The first pillar members 44 are made of the metal material; specifically, of aluminum. One of the first pillar members 44 is located at the outside of the shank 104 of the user, and an upper end of that first pillar member 44 is affixed to one of the knee-side base members 42. The other of the first pillar members 44 is located at the inside of the shank 104 of the user, and an upper end of that first pillar member 44 is affixed to the other of the knee-side base members 42. Each first pillar member 44 extends downward along the shank 104 of the user, and an upper end of each second pillar member 46 is affixed to a lower end of each first pillar member 44. As described in detail later, the first pillar members 44 are first replaceable members that can be replaced in accordance with the physical constitution of the user. That is, in the walk assistance device 10 of the present embodiment, the size (length) of the shank unit 40 can be adjusted by replacing the first pillar member 44 with another one having a different size (length).

The second pillar members 46 are rod-shaped members. The second pillar members 46 are made of the fiber-reinforced material; specifically, of carbon fiber reinforced plastic (CFRP). However, a metal fitting 47 made of metal material (specifically, aluminum) is provided at both ends of the second pillar members 46. One of the second pillar members 46 is located at the outside of the shank 104 of the user, and an upper end of that second pillar member 46 is affixed to one of the first pillar members 44. The other second pillar member 46 is located at the inside of the shank 104 of the user, and an upper end of that second pillar member 46 is affixed to the other first pillar members 44. Each second pillar member 46 extends downward along the shank 104 of the user, and a lower end of each second pillar member 46 is affixed to one respective ankle-side base member 48. As described in detail later, the second pillar members 46 are second replaceable members that can be replaced in accordance with the physical constitution of the user. That is, in the walk assistance device 10 of the present embodiment, the size (length) of the shank unit 40 can also be adjusted by replacing the second pillar member 46 with another one having a different size (length).

The ankle-side base members 48 are plate members. The ankle-side base members 48 are made of metal material; specifically, of aluminum. One of the ankle-side base members 48 is affixed to one of the ankle position joint units 50 at the outside of the shank 104 of the user, and the other ankle-side base member 48 is affixed to the other ankle position joint unit 50 at the inside of the shank 104 of the user.

As described above, the first pillar members 44 and the second pillar members 46 are replaceable members that can be replaced in accordance with the physical constitution of the user. Consequently, as shown in FIG. 3, the first pillar members 44 and the second pillar members 46 are fixed by bolts 12, 14, 16 and are configured to be easily replaceable. For example, the upper ends of the first pillar members 44 are affixed to the knee-side base members 42 by a plurality of the bolts 12. Further, the upper ends of the second pillar members 46 are affixed to the lower ends of the first pillar members 44 by a plurality of the bolts 14. The lower ends of the second pillar members 46 are affixed to the ankle-side base members 48 by a plurality of the bolts 14. Consequently, the first pillar members 44 and the second pillar members 46 can each be replaced by removing the bolts 12, 14, 16.

As described earlier, the second pillar members 46 are made of CFRP. Consequently, the metal fittings 47 are provided at both ends of the second pillar members 46 to receive the bolts 14, 16. Tenons 47*a* that protrude in a plate shape are formed in these metal fittings 47. Mortise grooves 44*a*, 48*a* for receiving the tenons 47*a* are formed in the second pillar members 46 and the ankle-side base members 48 respectively. According to this configuration, the first pillar members 44 and the second pillar members 46 can be affixed firmly without wobbling.

In the walk assistance device 10 of the present embodiment, the length of the shank unit 40 can be adjusted by replacing the first pillar members 44 and the second pillar members 46. That is, a plurality of the first pillar members 44 having different lengths, and a plurality of the second pillar members 46 having different lengths are prepared, and one of the first pillar members 44 and one of the second pillar members 46 are selected from among the prepared first pillar members 44 and the second pillar members 46 in accordance with the physical constitution of the user. By assembling the shank unit 40 using the selected first pillar member 44 and one of the second pillar members 46, the size of the shank unit 40 can be adjusted in accordance with the physical constitution of the user. According to this configuration, it is not necessary to form a long hole in the shank unit 40 for adjusting size, allowing loss of strength of the shank unit 40 to be avoided. Further, the length of the shank unit 40 does not change even if a strong force is applied to the shank unit 40. Consequently, the walking of the user can be assisted stably.

Further, in the walk assistance device 10 of the present embodiment, not just one single replaceable member but a plurality of replaceable members, including the first pillar members 44 and the second pillar members 46, is provided. Consequently, the length of the shank unit 40 can be adjusted in multistep lengths by combining the first pillar members 44 and the second pillar members 46. For example, in case the length of the shank unit 40 were to be adjusted using only the first pillar members 44, it would be necessary to prepare 30 pieces of the first pillar members 44 having different lengths to adjust the length of the shank unit 40 by 30 steps. By contrast, if the first pillar members 44 and the second pillar members 46 are combined, the length of the shank unit 40 could, as an example, be adjusted by 30 steps by preparing a total of 13 pieces of replaceable members: 10 pieces of the first pillar members 44 having different lengths and 3 pieces of the second pillar members 46 having different lengths. That is, the length of the shank unit 40 can be adjusted in multistep lengths having a greater number than the total number of first pillar members 44 and second pillar members 46 prepared.

In the present embodiment, the first pillar members 44 are made of aluminum, and the second pillar members 46 are made of CFRP. Here, the density (specific gravity) of aluminum is higher than that of CFRP. Consequently, the first pillar members 44 that have high density are designed to be shorter than the second pillar members 46 that have low density. According to this configuration, the weight of the shank unit 40 can be reduced. That is, in case the first pillar members 44 and the second pillar members 46 are made of different material, the weight of the shank unit 40 can be reduced by designing the member made of a high density material to be shorter and by designing the member made of a low density material to be longer. Thus, the burden on the user and the load applied to the knee position joint units 30 can be reduced.

In the present embodiment, the first pillar members 44 that are made of aluminum are located closer to the knee position joint units 30 than the second pillar members 46 that are made of CFRP. That is, the first pillar members 44 that have high density are located closer to the knee position joint units 30 than the second pillar members 46 that have low density. According to this configuration, the center of gravity of the shank unit 40 is located close to the knee position joint units 30, allowing the moment of inertia of the shank unit 40 to be smaller relative to the knee position joint units 30. Thus, in case the first pillar members 44 and the second pillar members 46 are made of different material, the moment of inertia of the shank unit 40 can be made smaller relative to the knee position joint units 30 by locating the member made of high density material closer to the knee position joint units 30 than the member made of low density material. Thereby, the burden on the user and the load on the knee position joint units 30 can be reduced.

Here, a supplementary explanation will be given of a method for adjusting the size (length) of the shank unit 40. Since processing of CFRP is generally difficult, preparing many of the second pillar members 46 from CFRP increases cost. By contrast, since processing of aluminum is comparatively easy, the second pillar members 46 that are made of aluminum can be manufactured at comparatively low cost. Consequently, in case a plurality of the first pillar members 44 and a plurality of the second pillar members 46 are prepared, it is better to prepare the first pillar members 44 made of aluminum in greater quantity than the second pillar members 46 made of CFRP. For example, in case the length of the shank unit 40 is to be adjusted by 30 steps, it is better to prepare 10 pieces of the first pillar members 44 and 3 pieces of the second pillar members 46 than to prepare 3 pieces of the first pillar members 44 and 10 pieces of the second pillar members 46. Thus, the first pillar members 44 and the second pillar members 46 that are used for replacement can be prepared at comparatively low cost.

Next, the frame structure of the foot unit 60 will be described with reference to FIG. 2. The foot unit 60 comprises a sole plate member 62, a pair of foot pillar members 64 and a pair of foot base members 66. The sole plate member 62 is arranged below the foot 106 of the user, i.e., on the sole of the user. The sole plate member 62 is configured such that it can be affixed to a shoe (not shown) of the user. Thus, the foot 106 of the user is maintained such that it cannot move longitudinally, horizontally or vertically relative to the sole plate member 62. Further, a position adjusting plate 63 is provided on the sole plate member 62 and extends to both sides of the sole plate member 62.

The foot pillar members 64 are plate members. The foot pillar members 64 are made of metal material; specifically, of aluminum. One of the foot pillar members 64 is affixed to the sole plate member 62 at the outside of the foot 106 of the user, and the foot pillar member 64 is affixed to the sole plate member 62 at the inside of the foot 106 of the user. Furthermore, each foot pillar member 64 is not affixed directly to the sole plate member 62, but is affixed to the position adjusting plate 63 of the sole plate member 62. Each foot pillar member 64 extends upward from the sole plate member 62, and an upper end of each foot pillar member 64 is affixed to one of the foot base members 66.

The foot base members 66 are long and narrow block-shaped members. The foot base members 66 are made of metal material; specifically, of aluminum. One of the foot base members 66 is affixed to one of the ankle position joint units 50 at the outside of the foot 106 of the user, and the foot base member 66 is affixed to the other ankle position joint unit 50 at the inside of the foot 106 of the user. That is, the foot base members 66 are coupled in a swingable manner with the ankle-side base members 48 of the shank unit 40 via the ankle position joint units 50.

In the foot unit 60, as well, the foot pillar members 64 form a third replaceable member that can be replaced in accordance with the physical constitution of the user. That is, in the walk assistance device 10 of the present embodiment, the size of the foot unit 60 can be adjusted by replacing the foot pillar members 64 with other ones having a different size. Furthermore, the term "size of the foot unit 60" here means the distance from the sole plate member 62 to the ankle position joint units 50. That is, the location of the ankle position joint units 50 relative to the ankle 105 of the user can be adjusted by replacing the foot pillar members 64.

Other features of the walk assistance device 10 will be given. The knee position joint units 30 are configured as a pair, and are located respectively at the outside and inside of the user's knee. The shank unit 40 has the pair of first pillar members 44 and the pair of second pillar members 46. The upper end of each first pillar member 44 is coupled with each of the pair of knee position joint units 30 via the pair of knee-side base members 42, and the lower end of each first pillar member 44 is coupled with the upper end of each of the pair of second pillar members 46.

An upper end of the shank unit 40 consists of the pair of knee-side base members 42 located at both sides of the user's knee, and the knee plate member 43 that passes across the front of the user's knee and couples the pair of knee-side base members 42. The pair of knee-side base members 42 is arranged in a parallel manner.

Specific embodiment of the present teachings is described above, but this merely illustrates some representative possibilities for utilizing the teachings and does not restrict the claims thereof. The subject matter set forth in the claims includes variations and modifications of the specific examples set forth above.

The technical elements disclosed in the specification or the drawings may be utilized separately or in all types of combinations, and are not limited to the combinations set forth in the claims at the time of filing of the application. Furthermore, the subject matter disclosed herein may be utilized to simultaneously achieve a plurality of objects or to only achieve one object.

What is claimed is:

1. A walk assistance device for assisting a user to walk, the device comprising:

a thigh unit configured to be arranged on a thigh of the user;

a shank unit configured to be arranged on a shank of the user;

a foot unit configured to be arranged on a foot of the user;

a knee position joint unit configured to couple the thigh unit and the shank unit in a swingable manner; and an ankle position joint unit configured to couple the shank unit and the foot unit in a swingable manner, wherein the shank unit comprises a first replaceable member and a second replaceable member configured to extend along the shank of the user, a length of the shank unit is adjustable by replacing each of the first and second replaceable members with alternative first and second replacement members, and the first replaceable member has a higher density than the second replaceable member, and is shorter than the second replaceable member.

2. The walk assistance device as in claim 1, wherein the first replaceable member is located closer to the knee position joint unit than the second replaceable member.

3. The walk assistance device as in claim 1, wherein the first replaceable member is made of metal material and the second replaceable member is made of fiber-reinforced material.

4. The walk assistance device as in claim 1, wherein the foot unit comprises a sole member configured to be arranged on a sole and a third replaceable member extending from the sole member to the ankle position joint unit, and a distance from the sole member to the ankle position joint unit is adjustable by replacing the third replaceable member with an alternative third replaceable member having a different length.

5. A method for adjusting size of the walk assistance device as in claim 1, the method comprising:

preparing a plurality of the first replaceable members having lengths different from each other and a plurality of the second replaceable members having lengths different from each other;

selecting one of the first replaceable members and one of the second replaceable members in accordance with a physical constitution of the user, and assembling the shank unit by using the selected first and second members, wherein a length of the shank unit is adjustable in multistep lengths by a variety of combinations of the first and second members which are selected, and a number of the multistep lengths is larger than a total number of the plurality of first and second members which are prepared.

6. The method as in claim 5, wherein the first replaceable member is made of metal material and the second replaceable member is made of fiber-reinforced material, and a number of the first replaceable members which are prepared is larger than a number of the second replaceable members which are prepared.

* * * * *